United States Patent [19]

Naslund

[11] Patent Number: 4,621,709

[45] Date of Patent: Nov. 11, 1986

[54] SOUND ATTENUATING PARTITIONS AND ACOUSTICAL DOORS

[75] Inventor: Edwin N. Naslund, Santa Rosa, Calif.

[73] Assignee: Cal-Wood Door, Santa Rosa, Calif.

[21] Appl. No.: 753,703

[22] Filed: Jul. 10, 1985

[51] Int. Cl.[4] ..... E04B 1/82

[52] U.S. Cl. ..... 181/284; 181/287; 181/288; 181/290

[58] Field of Search ..... 181/284, 287, 290, 288; 52/144, 145

[56] References Cited

U.S. PATENT DOCUMENTS

| | | | |
|---|---|---|---|
| 2,285,423 | 6/1942 | Esser | 181/290 |
| 2,671,522 | 3/1954 | Bourgeois | 52/144 X |
| 3,020,184 | 2/1962 | Cubberley et al. | 181/290 X |
| 3,121,262 | 2/1964 | Loncoske | 181/290 |
| 3,295,273 | 1/1967 | Wehe, Jr. | 52/145 |
| 3,319,738 | 5/1967 | Wehe, Jr. | 181/290 |
| 3,462,899 | 8/1969 | Sherman | 181/290 X |
| 3,652,360 | 3/1972 | Hartman et al. | 181/290 X |
| 4,045,913 | 9/1977 | Wright | 40/307 |

OTHER PUBLICATIONS

Measurements in Building Acoustics, Bruel & Kjaer, Instruments, Inc., 1980.

Test Report of Cal-Wood Door, Test RAL-TL85-24, Riverbank Acoustical Laboratories of IIT Research Institute, 2/21/85.

*Primary Examiner*—Benjamin R. Fuller

*Attorney, Agent, or Firm*—Majestic, Gallagher, Parsons & Siebert

[57] ABSTRACT

A sound attenuating partition or door construction which includes outside rigid panels having significantly different thicknesses, a void being left between the panels, a sheet characterized as a limp mass loosely hung within the void, and grooves cut into an inner surface of at least one of the outside panels in order that the void serves as a sound absorbing anechoic chamber.

7 Claims, 5 Drawing Figures

SOUND ATTENUATING PARTITIONS AND ACOUSTICAL DOORS

BACKGROUND OF THE INVENTION

This invention relates in general to sound attenuating partitions and in particular to sound attentuating or acoustical doors.

In the modern environment of increasing noise pollution, sound abatement has become an important consideration in both living and working quarters. To insulate against sound transmission from one area to another, a partition such as a conventional wall can act as a sound barrier. Generally, a more massive partition has a higher transmission loss. However this brute-force approach is not usually practical and is expensive.

Even with an adequate sound attenuating partition, a door installed in the partition presents a further opportunity for acoustical transmission from one side to the other. A door with a lower transmission loss can greatly depreciate the overall transmission loss of the partition. Accordingly, massive and expensive doors have been employed to minimize acoustical leakage. However, in most instances, it is both expensive and impractical to have doors as massive as the partitions.

Thinner and lighter weight doors, in particular ones with one and three quarters inch thicknesses are more standard in the building and construction industry. Acoustical doors of that thickness have been designed using high density materials such as metals (as disclosed in U.S. Pat. Nos. 3,319,738; 3,295,273) or chemically impregnated vinyl (as disclosed in U.S. Pat. No. 4,045,913) to achieve the performance level of the thicker more massive doors. However these prior art designs are still based on the principle of a massive sound barrier and therefore remain expensive to manufacture and relatively heavy.

SUMMARY OF THE INVENTION

It is an object of this invention to provide improved and more economical sound attenuating panels and acoustical doors.

It is another object of this invention to provide doors fabricated essentially from wood with a Sound Transmission Class rating of 36–40 plus as determined by the ATM E90-83 standard.

These and additional objects are accomplished by the various aspects of the present invention, which include, briefly, outside rigid panels of a door or partition having significantly different thicknesses, a void being left between the panels, a dense and flexible partition loosely hung within the void, and grooves cut into an inner surface of at least one of the outside panels in order that the void serves as a sound absorbing anechoic chamber.

The invention herein disclosed is best characterized as an acoustical door which comprises: a first and second outside rigid panels; a third panel including a rigid frame with its outer dimensions commensurate with said first and second panels, a dense and flexible partition suspended transversely by said rigid frame, said third panel being sandwiched between said first and second panels, thereby to form between their inner surfaces thereof an enclosed void therein with said partition suspended therein.

One feature of the present invention in order to improve sound transmission loss is to have a double partition formed by said first and second panels.

Another feature of the present invention in order to improve sound transmission loss is to have substantially different thicknesses for said first and second panels so as to avoid the coincidence dip of each panel being situated at the same frequency.

Yet another feature of the present invention in order to improve sound transmission loss is to have multiple recesses provided in one of the inner surface of said first and second panels so as to form an anechoic chamber.

Still another feature of the present invention in order to improve sound transmission loss is to have a dense and flexible partition in said anechoic chamber so as to act as an acoustical barrier.

Additional objects, features and advantages of the present invention will become apparent from the following description of a preferred embodiment thereof, which description should be taken in conjunction with the accompanying drawings.

DETAILED DESCRIPTION OF THE PREFERRED EMBODIMENT

Figure 1:
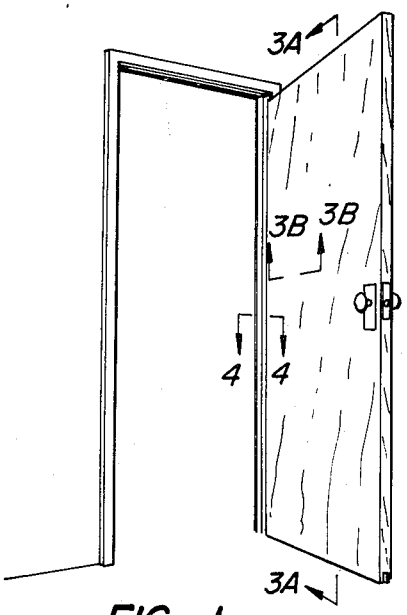
FIG. 1 is an overall view of the acoustical door and the door frame according to the preferred embodiment of this invention.
Figure 2:
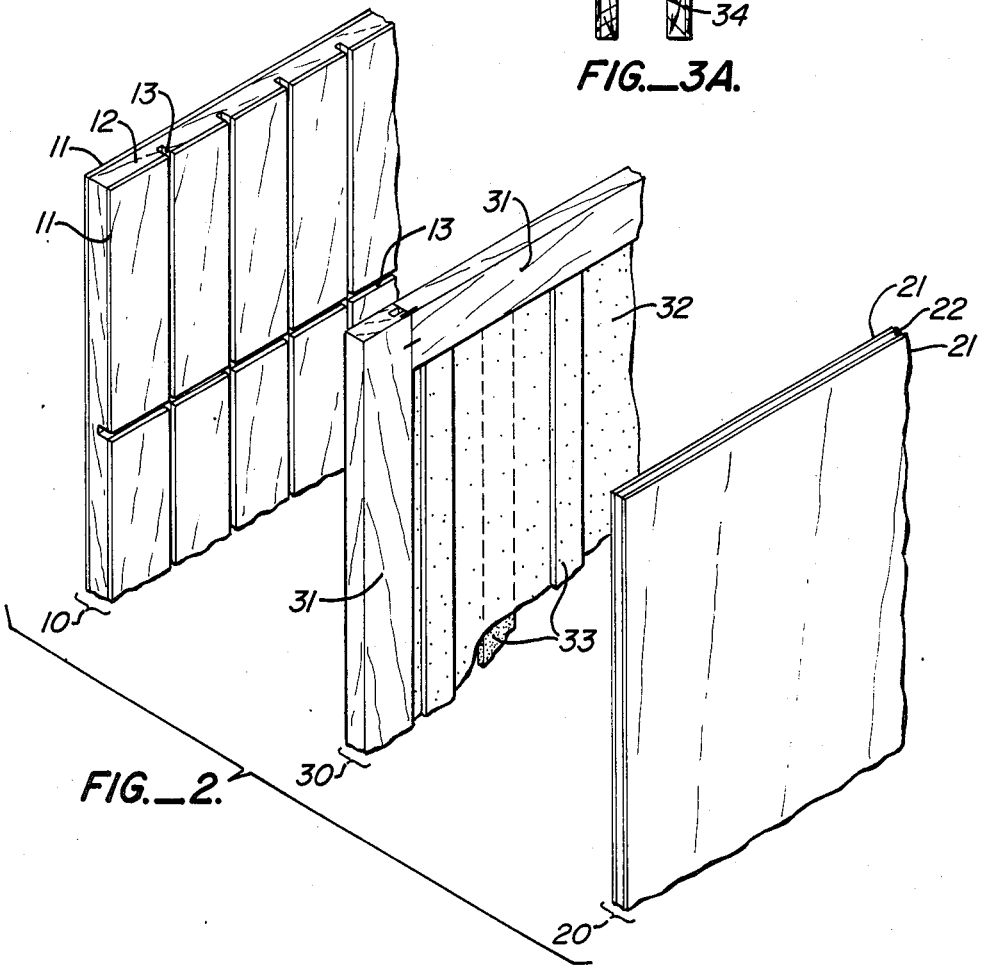
FIG. 2 is an exploded perspective view of the acoustical door partially cut away to illustrate the preferred embodiment of this invention.

FIG. 1 illustrates an overall view of the door mounted onto the door frame by hinges on one side. As illustrated in FIG. 2, the acoustical door comprises three main panels: a first outside rigid panel 10, a second outside rigid panel 20, and a middle panel 30.

In the preferred embodiment, the rigid panels are constructed from wood for ease of fabrication, economic and aesthetic considerations. Referring to FIG. 2, the first panel 10 is an approximately $\frac{3}{4}$ inch plywood sheet consisting of a lamination of a 60 pounds per cubic feet reconstituted wood fiber sheet 12 sandwiched in between two outer hardwood plywood sheets 11. Multiple saw kerfs 13 approximately $\frac{1}{8}$ inch wide and approximately $\frac{3}{8}$ inch deep are cut on one surface of the first panel 10 which is designated as the inside surface. The vertical kerfs in this example, are spaced approximately 2 inches apart over substantially the whole of the inside surface. Only a few horizontal kerfs are required, three being found satisfactory, one in approximately the middle and the other two approximately one foot from the door's top and bottom. This structure serves as an anechoic surface where the recesses trap the sound and convert the sound energy into heat energy by friction. The kerfs also makes the panel 10 more flexible, thereby detuning the two panels 10 and 20 further and increasing the effectiveness of the structure.

The second outside rigid panel 20 is an approximately $\frac{1}{2}$ inch plywood of essentially the same type of lamination as the first panel 10. It is a property of acoustic transmission in rigid flat panels that there exists a narrow frequency range, called the "concidence dip" where the panel is almost acoustically transparent. For a given material, the frequency of the dip is inversely proportional to the thickness of the panel. The two panels 10 and 20 are therefore chosen to have different thicknesses in order to avoid the coincidence dip of each panel being situated at the same frequency.

Figure 3A:
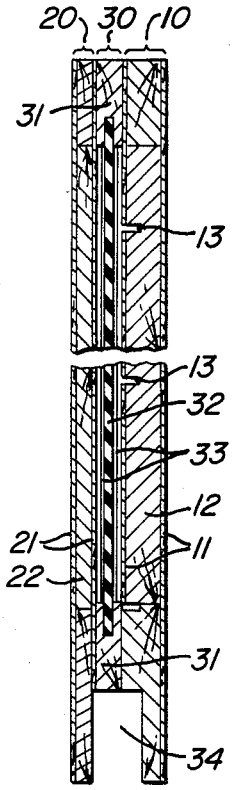
FIG. 3A is a cross-sectional illustration of the acoustical door along the line 3A—3A of FIG. 1.

The middle panel 30 is constructed out of an approximately ½ inch thick rectangular wooden frame 31 with its transverse outer dimensions being commensurate with that of the first and second panels 10 and 20. An approximately ¼ inch thick high density barium sulfate impregnated vinyl sheet 32 is framed by the frame 31. Referring to FIG. 3A, the vinyl sheet 32 is secured by inlaying into slots running centrally along the inner surfaces defining the inner perimeter of the frame 31. The vinyl sheet 32 acts as a limp mass which serves as an effective sound barrier and its flexibility also accords it with a sound absorption attribute.

Figure 3B:
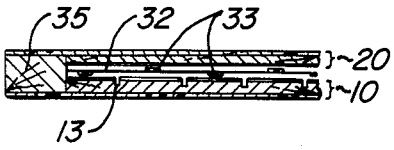
FIG. 3B is a cross-sectional illustration of the acoustical door along the line 3B—3B of FIG. 1.

The three panels are laminated together with the middle panel 30 being sandwiched by the two outside panels 10 and 20 as illustrated by a cross-sectional view in FIG. 3A. In this way is formed a void enclosed by the inside surfaces of the first and second panels 10 and 20, and the frame of the middle panel 30. The void is only partially occupied by the vinyl sheet 32 since the latter is substantially thinner than the thickness of the frame 31. In the preferred embodiment, a layer of space of approximately ⅛ inch thick remains between each surface of the vinyl sheet 32 and the adjacent inside surfaces of the panels 10 and 20. Thin strips of foam 33 are adhered to opposite surfaces of the vinyl sheet 32 in the manner illustrated by FIG. 2 and FIG. 3B to prevent the flexible vinyl from contacting the inner surfaces of the panels 10 and 20, especially during the course of fabrication when the panels are laid flat on top of each other. The strips 33 are alternately positioned so that no two strips are positioned opposite each other.

A stile 35 is installed on a vertical edge of the finished door. A like stile (not shown) is provided on the other vertical edge. The stiles provide for attachment of door hardware.

Figure 4:
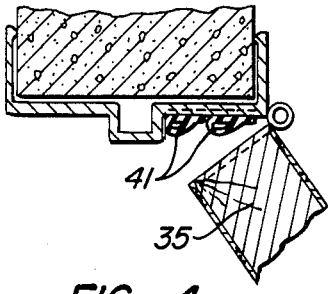
FIG. 4 is a cross-sectional illustration of the acoustical door and the door frame with the door gaskets along the line 4—4 of FIG. 1.

It is generally found that the higher a partition is rated on sound transmission loss, the greater the effect a small opening has on undermining that quality. Thus the full potential of a partition with high sound transmission lose could only be realized when careful attention is paid to eliminating all sources of acoustical leaks. In the preferred embodiment when the acoustical door is mounted on a door frame, the clearance between the two must be carefully sealed. For the top (head) and two vertical side (hinge and latch) jambs of the door frame, a commercially available silicone rubber door gasket may be used to close the acoustical leaks. The door gasket is in the form of a somewhat oval-shaped resilient tubing which is adhered to and forms a continuous lining along the jambs. FIG. 4 is a cross-sectional view taken along line 4—4 of FIG. 1 which illustrates the preferred embodiment where two gasket strips 41 are installed side by side along the full length of the three jambs of the door frame. The seal along the bottom part of the door is accomplished in one form by a commercially available automatic drop seal. Provision for installation of such device has been made by way of a slot 34 at the bottom of the acoustical door as illustrated by FIG. 3A.

A sample of the preferred embodiment, when properly sealed, has been measured to have a Sound Transmission Class rating of 39 as determined by the ASTM E90-83 standard.

The above description of method and the construction used is merely illustrative thereof and various changes of the details and the method and construction may be made within the scope of the appended claims.

It is claimed:

1. An acoustical door, comprising:

first and second outside rigid panels held spaced apart by connections at their edges, thereby to form between inner surfaces thereof an enclosed void therein;

said first and second panels having substantially different thicknesses from each other; and at least one of the inner surfaces having multiple recesses made therein, thereby to form an absorptive acoustical trap;

a sheet of material substantially more dense and flexible than said first and second panels, and held in between said first and second panels by said connections at their edges;

said sheet having a thickness substantially less than that of said enclosed void, thereby to form an absorptive acoustical barrier.

2. An acoustical door as recited in claim 1 which further comprises strips of materials attached alternately along one dimension of said dense sheet on opposite sides thereof, thereby to offset said dense sheet from the inner walls of said first and second panels.

3. An acoustical door as recited in claim 1, wherein said dense sheet is comprised of a barium sulfate impregnated vinyl sheet.

4. An acoustical door as recited in claim 2, wherein said dense sheet is comprised of a barium sulfate impregnated vinyl sheet.

5. An acoustical door assembly, which includes an acoustical door as recited in claim 1, and a door frame comprising:

two vertical side jambs and a horizontal head jamb, forming three sides of the door frame;

means for hinging said acoustical door onto the door frame;

a plurality of parallel strip gaskets extending adjacent each other along the length of said side and head jambs, each of which forms a continuous lining for the clearance between said acoustical door and said three jambs.

6. An acoustical door assembly as recited in claim 5, wherein said strip gaskets are comprised of elliptical rubber tubings attached to said three jambs.

7. An acoustical door which includes:

a first outside rigid panel;

a second outside rigid panel;

said first and second panels having substantially different thicknesses from each other; and at least one of the inner surfaces of said first and second panels having a multitude of kerfs cut therein, said kerfs having as much a depth as practical without compromising the rigidity of said panel;

a third panel, comprising a rigid frame which is sandwiched in between and having its outer dimensions commensurate with said first and second panels, thereby to form an enclosed void therein and a sheet of material substantially more dense and flexible than said first and second panels and having a thickness substantially less than that of said rigid frame and suspended by it transversely in the enclosed void.

* * * * *